United States Patent [19]

Ban

[11] 4,039,427

[45] Aug. 2, 1977

[54] PROCESS FOR RETORTING OIL SHALE

[75] Inventor: Thomas E. Ban, South Euclid, Ohio

[73] Assignee: McDowell-Wellman Engineering Company, Cleveland, Ohio

[21] Appl. No.: 644,927

[22] Filed: Dec. 29, 1975

[51] Int. Cl.[2] ..... C10G 1/02

[52] U.S. Cl. ..... 208/11 R; 201/22; 201/32; 201/40

[58] Field of Search ..... 208/11 R; 201/22, 32, 201/40

[56] References Cited

U.S. PATENT DOCUMENTS

| | | | |
|---|---|---|---|
| 3,325,395 | 6/1967 | Ban | 208/11 R |
| 3,441,480 | 4/1969 | Ban | 208/8 |
| 3,483,115 | 12/1969 | Haddad et al. | 208/11 R |
| 3,516,787 | 6/1970 | Van Nordstrand | 208/11 R |
| 3,560,368 | 2/1971 | Rowland et al. | 208/11 R |

*Primary Examiner*—Delbert E. Gantz
*Assistant Examiner*—James W. Hellwege
*Attorney, Agent, or Firm*—NcNenny, Pearne, Gordon, Gail, Dickinson & Schiller

[57] ABSTRACT

A process for the recovery of oil from oil-bearing shale and for employing the oil-depleted shale as a combustible heat source. The oil-bearing shale is charged on a traveling grate to form a burden. A bed of oil-depleted shale having uncombusted carbon and hydrocarbons is provided, and those uncombusted materials are combusted to raise the temperature of the bed to above about 1000° F. A reducing atmosphere is passed through the oil-depleted and combusted bed to raise the temperature of the reducing atmosphere. The heated reducing atmosphere is then passed through the burden to raise the temperature of the oil shale to at least 800° F. and to thereby educt oil from the oil shale. In another embodiment, the combusted oil-depleted material is layered onto the oil-bearing and the reducing atmosphere is passed sequentially through the oil-depleted and oil-bearing material.

5 Claims, 3 Drawing Figures

Fig. 2
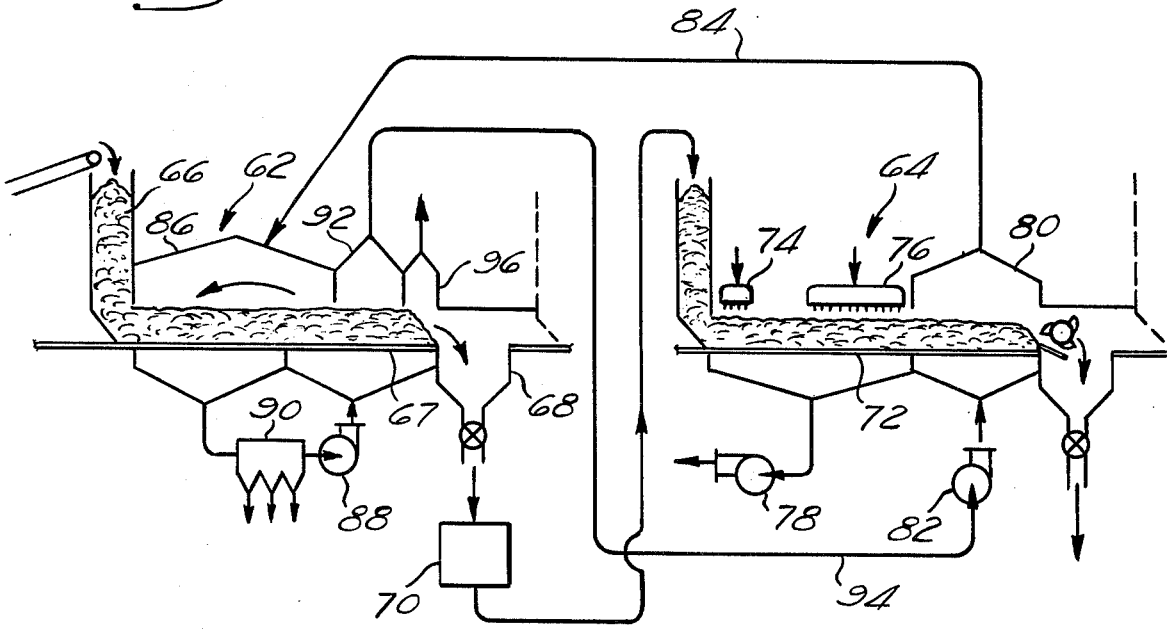
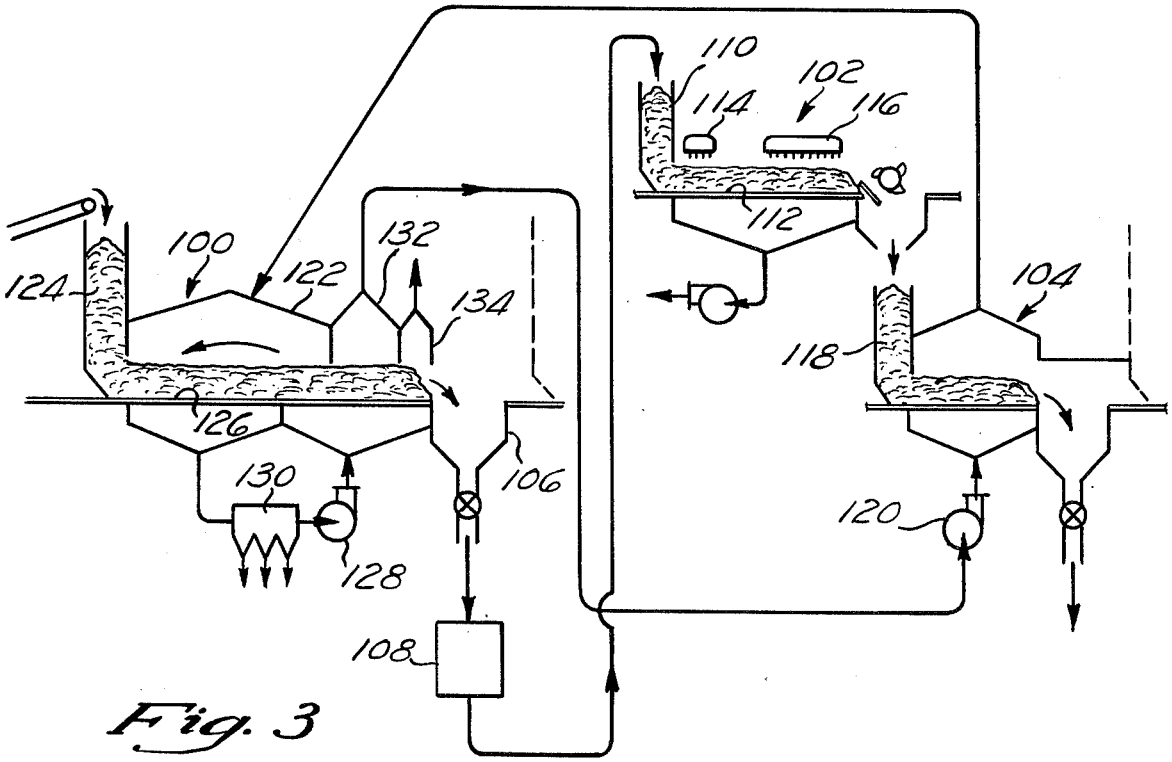
Fig. 3

PROCESS FOR RETORTING OIL SHALE

BACKGROUND OF THE INVENTION

This invention relates to a process for the recovery of oil from oil-bearing shale and for employing the oil-depleted material as a combustible heat source in the process. As is pointed out in U.S. Pat. No. 3,325,395, extremely large deposits of oil-bearing shale are known to exist in the United States, and particularly in Colorado and Wyoming. Shale rock and certain oil sands contain a substance called "kerogen" or "petrogen", which is an organic, waxy compound. When heated to a temperature of about 800° F., and in a nonoxidizing atmosphere, it cracks partially to yield a substance which has the properties resembling crude oil. In fact, any organic or organic-containing material will yield such a substance when treated in this manner.

The aforementioned patent presents two basic species of oil shale treatment. One aspect of the heated draft recycle system in that patent involves the partial combustion by an air fuel of the circulating retort draft stream which comes from the cooling zone and is used for sustaining the heating cycle in the retorting zone. Another aspect of the heated draft recycle system involves the heated recycle draft-air draft combustion system which embodies partial in situ combustion of the shale undergoing retorting. The first-mentioned system, while having many preferred aspects, results in the dilution of the shale gas by the air fuel, so that the shale gas is not usable as a fuel byproduct of the process. It has been found that the B.T.U. content of the shale gas is reduced from about 400 B.T.U. to about 100 B.T.U., due to dilution by the air fuel. The second-mentioned system also has disadvantages if liberated and recoverable minerals, such as nahcolite, dawsonite, and trona, are inherent in the oil shale. Commercial in situ combustion of shale undergoing retorting causes partials of the retorting bed to acquire temperatures in excess of 1800° F. to thereby fuse the minerals into an agglomerate. Agglomeration of the minerals interferes with efficient physical mineral separation.

SUMMARY OF THE INVENTION

This invention provides a heat source for the oil shale which is a byproduct of the sintering process to effectively produce oil, rich shale gas, and minerals in a form which may be efficiently separated by physical operations. According to this invention, oil-depleted material containing uncombusted carbon and hydrocarbons is used as a combustible heat source to educt oil from oil-bearing material. The oil-bearing material is charged on a traveling grate to form a burden, and the remaining carbon and hydrocarbons in the bed of oil-depleted material are combusted to raise the temperature of the bed to above about 1000° F. A reducing atmosphere is passed through the oil-depleted and combusted bed to raise the temperature of the reducing atmosphere. The heated reducing atmosphere is then passed through the oil-bearing material to raise the temperature of the oil-bearing material to at least about 800° F., to thereby educt oil from the oil-bearing material.

According to one preferred aspect of the present invention, the oil-bearing material is layered on a sealed, circular traveling grate to form the burden. On a separate grate, oil-depleted material recycled from the discharge station of the circular traveling grate and having uncombusted carbon and hydrocarbons contained therein is combusted to raise the temperature thereof to between about 1000° F. and 1700° F. The oil-depleted combusted material is then layered onto the burden of oil-bearing material. Adjacent the discharge zone for the oil-depleted, uncombusted material and for the oil-depleted, combusted material, a reducing atmosphere is updrafted through those materials to raise the temperature of the reducing atmosphere. The reducing atmosphere is then downdrafted through the aforementioned layers to further raise its temperature to between about 1000° F. and 1700° F. As the heated reducing atmosphere passes through the oil-bearing material, the temperature of the oil-bearing material is raised to above about 800° F. This temperature educts oil from the material and the oil is separated and collected. At the discharge station, the combusted oil-depleted material is sliced from the uncombusted oil-depleted material and is sent to a waste area. The uncombusted oil-depleted material is recycled to the combustion grate by way of a mineral reclamation station if the material contains such valuable minerals.

According to other aspects of this invention, the reducing atmosphere may be passed through the heated, oil-depleted, and combusted material at a separate location apart from the main circular traveling grate and cycled back to the main grate as a heated, reducing atmosphere.

BRIEF DESCRIPTION OF THE DRAWINGS

FIG. 2 is a schematic flow sheet illustrating another aspect of this invention; and FIG. 3 is a schematic flow sheet illustrating a still further aspect of the present invention.

DETAILED DESCRIPTION OF THE INVENTION

Figure 1:
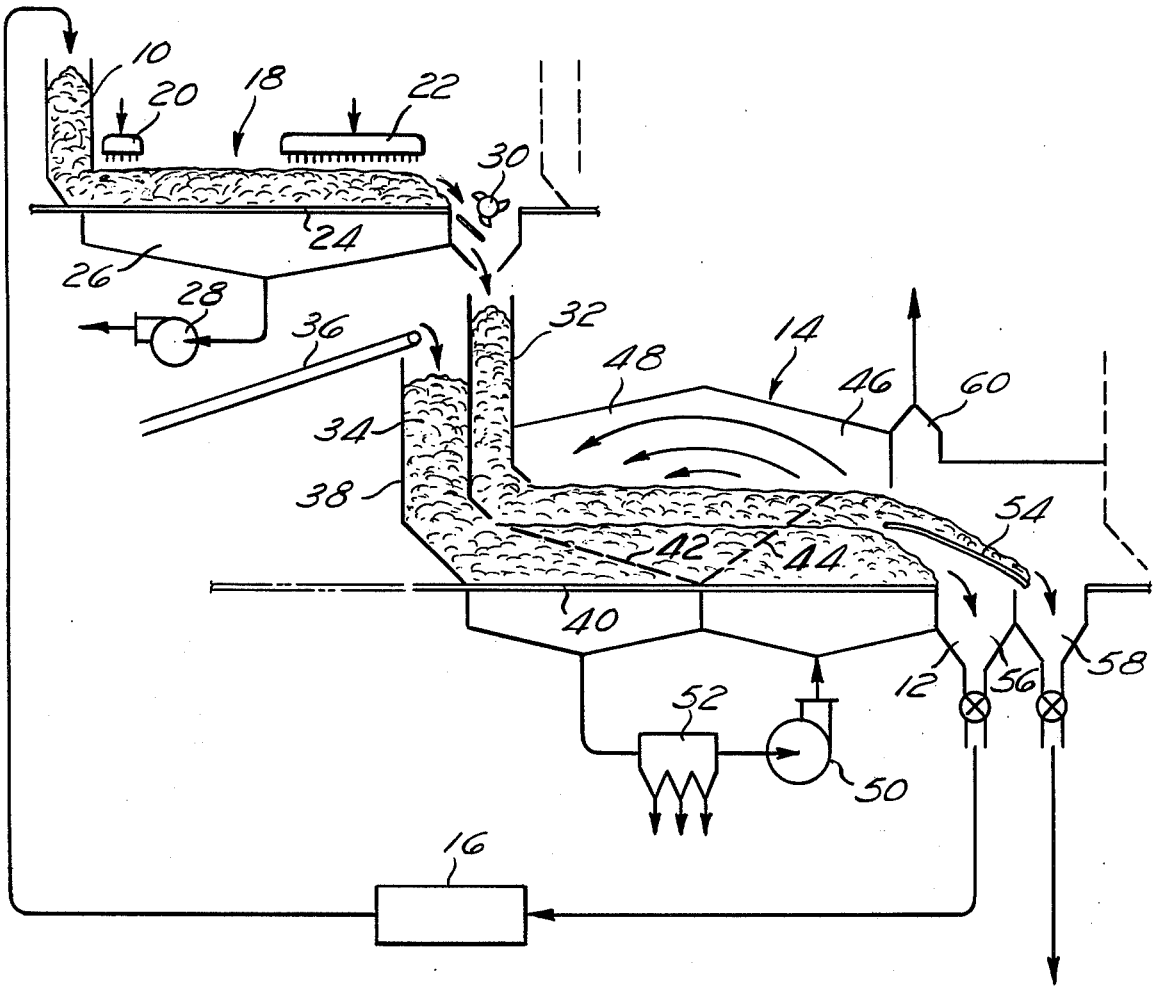
FIG. 1 is a schematic flow sheet illustrating one aspect of the present invention.

Referring now to FIG. 1, there is illustrated a method of recovering and using spent retorted shale 10 from the retorting operation which contains from about 2 to 5% combustible materials. The spent shale 10 as directed from a spent shale discharge station 12 of a circular traveling grate machine or retort 14 is directed to a spent shale processing system 16. The circular traveling grate machine 14 may be of the type set forth in U.S. Pat. No. 3,302,936, the disclosure of which is incorporated herein by reference. In the spent shale processing system 16, the spent shale 10 is subjected to mineral separation for removal of valuable products, such as the carbonates nahcolite, dawsonite, and trona, and/or other valuable and recoverable minerals. Ordinarily, this is accomplished by a crushing-grinding operation for liberation of the minerals and mineral dressing operations such as sizing, gravity, hydraulic or flotation schemes. The tailings from such mineral dressing operations contain the original combustible, organic material and the tailings are nodulized or pelletized, or directly charged to a separate traveling grate 18 for sintering-heating of the spent shale.

The separate traveling grate machine 18 is provided with an ignition burner 20, followed by a heating burner 22 for burning the combustibles of the spent shale and transferring the heat to the solid materials, which convert to a hot, inert, solid product. This material is conveyed along a traveling grate 24 and a downdraft is created in a windbox 26 by a blower 28. The material, when caked, is directed through a rotary breaker 30 and fed directly into a charge hopper 32, where it is applied as a 1000° to 1700° F. granular charge as a heating medium.

Raw oil shale 34 is conveyed to the retort 14 by a conveyor 36, and is fed into a charging chute 38 as a bottom layer on a traveling grate 40. The bottom layer is subjected to downdraft retorting by a hot reducing recuperated gas which becomes reheated by the heating medium in the retorting zone, which comprises the top layer. This perpetuates a heating front of above 800° F., which is necessary for retorting oil shale. The 800° F. heating front is schematically illustrated as the roughly triangular-shaped area above dotted lines 42 and 44, which represent an 800° F. isotherm. As the dual layer charge enters a cooling zone 46, an updraft of recycled draft cools the shale and becomes preheated by the upper layer. The heated reducing atmosphere again passes through a hotter portion of the upper layer in a heating zone 48, where the reducing atmosphere is downdrafted through the layers. Circulation of the reducing atmosphere is provided by a blower 50 and educted oil is separated from the reducing atmosphere by an oil separator 52.

As the dual layer is about to discharge, it enters a layer stripper plate 54 which isolates the spent shale lower layer from the shale ash upper layer and directs the two into separated, sealed discharge hoppers 56 and 58.

Rich, undiluted shale gases are drawn from the system at a collection hood 60 for later use as a fuel.

Referring now to FIG. 2, there is illustrated an oil shale retorting process for the production of oil, rich shale gas, and recoverable minerals by using separate sintering systems for heating the retorting draft. In FIG. 2, two separate sintering machines 62 and 64 are employed. Those machines are preferably circular traveling grate machines and the machine 62 should be sealed. The machine 62 is employed for retorting of oil-shale 66 and the machine 64 is employed for sintering, heating, and heat transfer. Oil-depleted shale having combustibles therein is conveyed by a traveling grate 67 to a discharge hopper 68 and then conveyed through a mineral processing station 70, where valuable minerals are removed. The shale is then charged on a traveling grate 72 in the machine 64, and initially ignited by a burner 74 and then combusted by a burner 76. A downdraft is provided in the combustion zone by a blower 78. An updraft of reducing atmosphere is passed through the heated, spent shale at a cooling zone 80 by a blower 82 to thereby raise the temperature of the reducing atmosphere to between 1000° and 1700° F. The heated atmosphere is then conducted to the traveling grate machine 62 by a suitable conduit 84. The heated reducing atmosphere is fed into the machine 62 in a heating zone 86 and is downdrafted through the oil shale by a blower 88. Prior to reaching the blower, however, the oil-laden atmosphere is passed through an oil extraction device 90. The reducing atmosphere is updrafted through the shale adjacent the discharge portion of the machine and a portion of the updrafted gas is cycled directly to the input or feeding portion of the machine while another portion is collected by a hood 92 and is conducted to the blower 82 via a conduit 94. Rich shale gas is drawn off adjacent the discharge hopper 68 by way of a hood 96.

Referring now to FIG. 3, there is illustrated a process involving the use of three separate traveling grate machines 100, 102, and 104. The machines 100 and 104 are sealed and are preferably circular traveling grate machines. Oil-depleted, combustible-containing shale is discharged from the machine 100 into a hopper 106. The discharged shale is then fed through a minerals processing station 108, where recoverable minerals are separated from the shale and the shale is then conveyed to a feed hopper 110 of the machine 102. A traveling grate 112 conveys the combustible-containing shale past an ignition burner 114 and then past a combustion burner 116 to raise the temperature of the shale to between about 1000° F. to 1700° F. The heated shale is then conveyed to a feed hopper 118 of a traveling grate machine 104, where a reducing gas is updrafted through the burden by a blower 120 and is heated by the burden. The heated gas is delivered to a hood portion 122 of the heating section of the machine 100. Oil-bearing shale 124 is conveyed through the heating section of the machine 100 by a traveling grate 126 and is heated to a temperature in excess of 800° F. by the heated reducing gas from the machine 104, which is downdrafted through the burden by a blower 128. Oil is separated from the gas at an oil separation station 130 and the reducing gas is updrafted through the burden at a cooling station to cool the burden and thereby pick up heat, part of which is circulated into the heating zone to be downdrafted and part of which is directed to a hood 132 and then to the blower 120 for updrafting in the machine 104. Rich shale gas is collected and drawn from a hood 134 at the discharge end of the machine 100.

While the invention has been described in connection with specific embodiments thereof, it is to be clearly understood that this is done only by way of example, and not as a limitation to the scope of the invention as set forth in the objects thereof and in the appended claims.

What is claimed is:

1. A continuous process for the recovery of oil from oil-bearing material and for employing oil-depleted material formed in the process and having uncombusted remaining carbon and hydrocarbons as a combustible heat source, comprising the steps of charging the oil-bearing material on a traveling grate to form a burden, passing a heated reducing atmosphere through the burden of oil-bearing material to raise the temperature of the oil-bearing material to at least about 800° F., to thereby educe oil from the oil-bearing material, and to thereby provide a bed of oil-depleted, combustible material, separating oil from the reducing atmosphere, discharging the oil-depleted material from the traveling grate, combusting remaining carbon and hydrocarbons in said oil-depleted material to raise the temperature of the bed to above about 1000° F., and passing said reducing atmosphere through the oil-depleted and combusted bed of material to raise the temperature of the reducing atmosphere, said combusted oil-depleted material being layered onto the oil-bearing material on the traveling grate and the reducing atmosphere being passed first through the combusted, oil-depleted material, and then through the oil-bearing material.

2. A process according to claim 1, wherein the oil-bearing and oil-depleted materials are shale.

3. A process according to claim 2, wherein mineral carbonates are recovered from the oil-depleted shale prior to combusting the shale.

4. A process according to claim 3, wherein said carbonates are selected from the group consisting of nahcolite, dawsonite, and trona.

5. A method according to claim 1, wherein the remaining carbon and hydrocarbons in the bed of oil-depleted material are combusted on a separate traveling grate.

* * * * *